US005408984A

United States Patent [19]

Maughan

[11] Patent Number: 5,408,984

[45] Date of Patent: Apr. 25, 1995

[54] TWO STAGE FLAME STABILIZATION FOR A GAS BURNER

[75] Inventor: James R. Maughan, Scotia, N.Y.

[73] Assignee: General Electric Company, Schenectady, N.Y.

[21] Appl. No.: 96,243

[22] Filed: Jul. 26, 1993

[51] Int. Cl.[6] ..... F24C 3/00

[52] U.S. Cl. ..... 126/39 E; 126/39 H; 126/39 D

[58] Field of Search ..... 431/328, 326; 126/39 E, 126/39 H, 39 D

[56] References Cited

U.S. PATENT DOCUMENTS

| | | | |
|---|---|---|---|
| 4,541,407 | 9/1985 | Sommers et al. | 126/39 E |
| 4,829,981 | 5/1989 | Burrell | 126/39 E X |
| 4,889,481 | 12/1989 | Morris et al. | 431/328 |
| 5,017,129 | 5/1991 | Velie et al. | 431/326 |
| 5,024,209 | 6/1991 | Schaupert | 126/39 H |
| 5,057,007 | 10/1991 | Andringa et al. | 431/326 X |
| 5,133,657 | 7/1992 | Harris | 431/326 |
| 5,147,201 | 9/1992 | Xiong | 431/7 X |
| 5,224,856 | 7/1993 | Nakamura | 431/328 |

*Primary Examiner*—Larry Jones

*Attorney, Agent, or Firm*—Patrick R. Scanlon; Paul R. Webb, II

[57] ABSTRACT

This invention relates to a gas burner which employs a two stage flame stabilizer. At low input rates, a fully aerated flame is stabilized at the surface of a porous material. At higher input rates, the flame blows off and is held by flame stabilization tabs. Such structures of this type, generally, operate over a very wide range of input rates and employ a highly aerated flame which reduces the flame temperature, slows NOx production, and increases the overall reaction rate by shortening the flame while reducing carbon monoxide (CO) caused by flame impingement.

13 Claims, 2 Drawing Sheets

TWO STAGE FLAME STABILIZATION FOR A GAS BURNER

BACKGROUND OF THE INVENTION

1. Field of the Invention

This invention relates to a gas burner which employs a two stage flame stabilizer. At low input rates, a fully aerated flame is stabilized at the surface of a porous material. At higher input rates, the flame blows off and is held by flame stabilization tabs. Such structures of this type, generally, operate over a very wide range of input rates and employ a highly aerated flame which reduces the flame temperature, slows NOx production, and increases the overall reaction rate by shortening the flame while reducing carbon monoxide (CO) caused by flame impingement.

2. Description of the Related Art

It is known, in gas appliance burners, to make use of a porous wire gauze. As shown in FIG. 1, gas appliance burner 2, includes in part, tube 4, porous wire gauze 6, fuel-air inlet 8, flame 10, stove top 12, conventional cookware 14, and cover plate 16. During the operation of conventional gas appliance burner 2, fuel and air are introduced through inlet 8 into tube 4. This fuel and air mixture then interacts with gauze 6 and is combusted such that flame 10 is created. Located above flame 10 is conventional cookware 14. Cookware 14 may, for example, be a sauce pan. Cookware 14 is located on top of stove top 12. Optionally, a high temperature ceramic cover plate 16 may be located over the opening in stove top 12 where the heat from flame 10 interacts with cookware 14. While such a burner system 2, often termed an infrared burner, has met with a degree of commercial success, there are several problems associated with this conventional burner 2.

One of the problems with burner system 2 is a cleanability problem. As can be seen in FIG. 1, if liquids contained within cookware 14 were allowed to boil over cookware 14, these liquids may come in contact with gauze 6 and flame 10, thereby, reducing the efficiency of flame 10. However, if plate 16 is placed over the hole in cooktop 12, then, there are problems associated with the use of plate 16. For example, plate 16, typically, is a ceramic glass plate. These ceramic glass plates are expensive. Also, there is a possibility that the ceramic glass plate 16 may be broken if cookware 14 is accidently dropped upon plate 16. Finally, burner system 2 has a narrow operating range. Ideally, a burner should operate between 1,000 and 10,000 BTU/hr. However, burner 2, typically, operates only between 3,000 and 10,000 BTU/hr. The importance of the lower BTU range, namely, between 1,000 and 3,000, is that in this range, the burner operates in what is commonly referred to as the "simmer" heating range. If burner 2 is not capable of achieving this lower BTU range, then burner 2 is not able to perform the "simmer" operation which is necessary of all stove tops in order to cook with a very low amount of heat. Therefore, a more advantageous burner, then, would be presented if a wider BTU range could be achieved while allowing the burner to be inexpensive and easily cleaned.

It is apparent from the above that there exists a need in the art for a gas burner which is inexpensive, and which at least equals the cleaning characteristics of the known gas burners, but which at the same time is capable of operating over a larger BTU range. It is a purpose of this invention to fulfill this and other needs in the art in a manner more apparent to the skilled artisan once given the following disclosure.

SUMMARY OF THE INVENTION

Generally speaking, this invention fulfills these needs by providing a gas burner, comprising a fuel/air introduction means, a flame stabilization means located adjacent to said fuel/air introduction means, a flame means located adjacent to said flame stabilization means, and a flame holding means located adjacent to said flame means.

In certain preferred embodiments, the flame stabilization means is a porous wire gauze located around an outer circumference of the fuel/air introduction means. Also, the flame holding means are tabs located around the circumference of the fuel/air introduction means. Finally, the flame means are a simmer flame and a cooking flame.

In another further preferred embodiment, the flame stabilization means and the flame holding means will stabilize the flame and not allow the flame to blow off of the gauze thereby reducing the flame temperature which slows NOx production and increasing the overall reaction rate which shortens the flame and reduces carbon monoxide (CO) cause by flame impingement.

The preferred gas burner, according to this invention, offers the following advantages: wide operating range and excellent turndown; lightness in weight; ease of assembly and repair; increased flame stabilization; reduced NOx and CO emissions; reduced flame temperature; reduced flame blow off; good economy; and high strength for safety. In fact, in many of the preferred embodiments, these factors of wide operating range, excellent turndown, flame stabilization, reduced NOx and CO emissions, reduced flame temperature, and reduced flame blow off are optimized to an extent that is considerably higher than heretofore achieved in prior, known gas burners.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several views and in which.

DETAILED DESCRIPTION OF THE INVENTION

Figure 1:
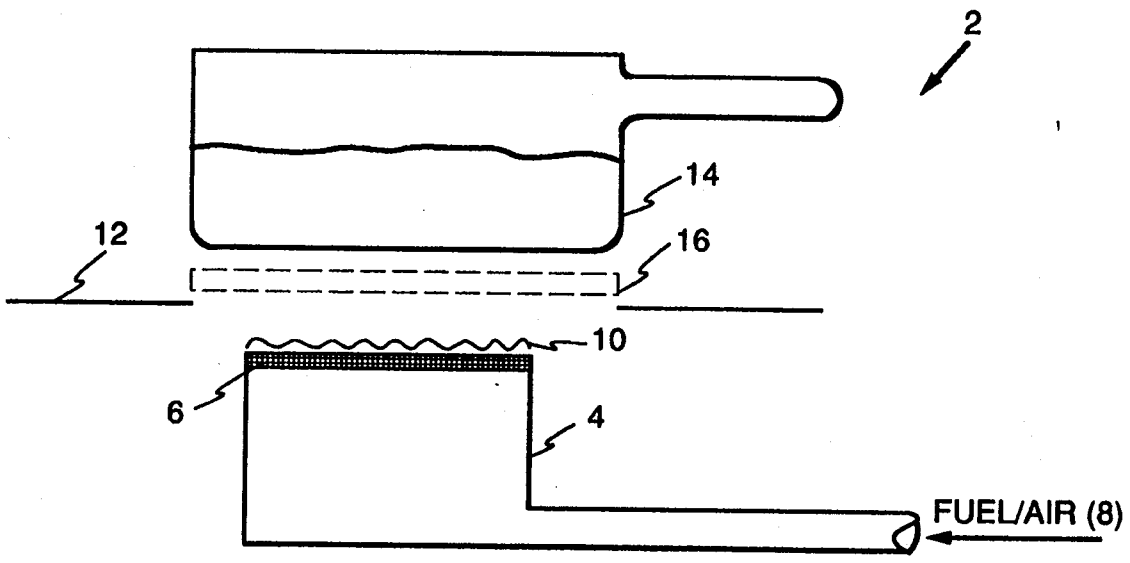
FIG. 1 (PRIOR ART)
FIG. 1 is a schematic illustration of a conventional gas burner, according to the prior art.

As discussed earlier with respect to FIG. 1, FIG. 1 illustrates a conventional gas burner system 2. Burner 2 includes tube 4, gauze 6, fuel/air inlet 8, flame 10, cooktop 12, cookware 14, and optional plate 16.

Figure 2:
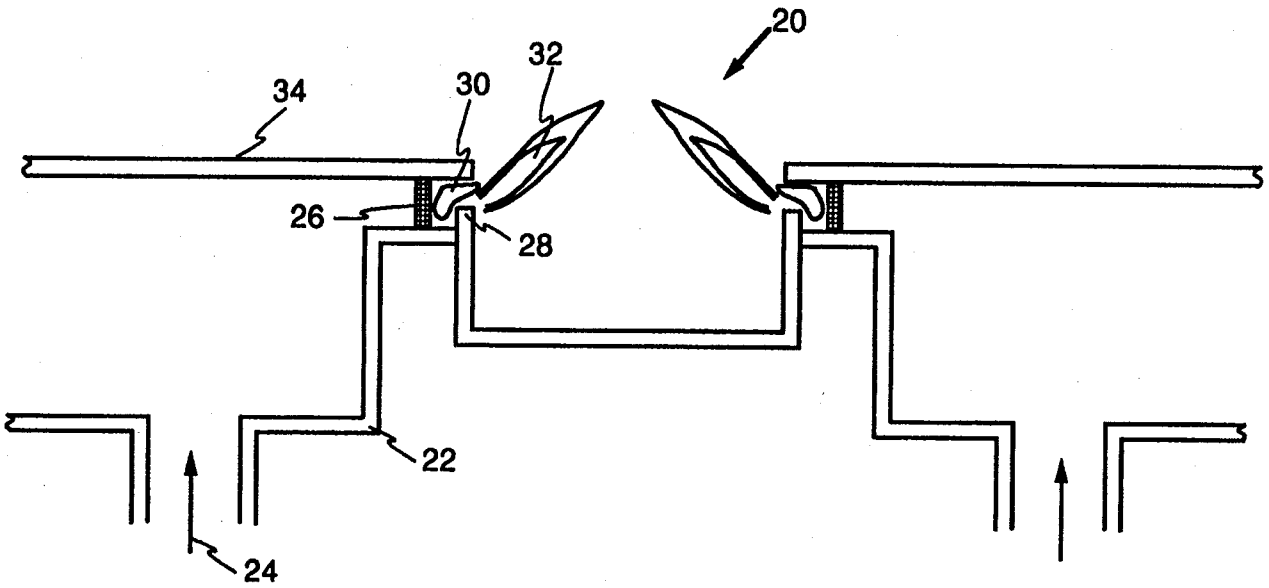
FIG. 2 is a schematic side plan view of a two stage flame stabilization system for a highly aerated gas burner, according to the present invention.
Figure 3:
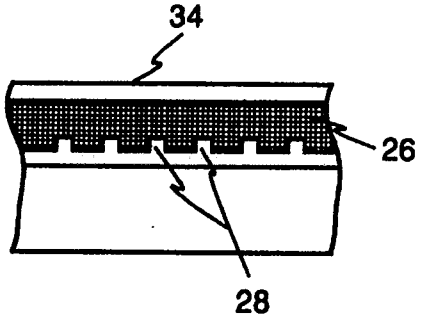
FIG. 3 is an end view of a two stage flame stabilization system for a highly aerated gas burner, according to the present invention.

With reference to FIGS. 2 and 3 there is illustrated two stage flame stabilization burner 20. Burner 20 includes, in part, fuel/air mixing area 22, fuel/air inlet 24, porous wire gauze 26, flame stabilization tabs 28, simmer flame 30, cooking flame 32, and cooktop 34. It is to be understood that wire gauze 26 may also be porous metal or ceramic. Also, tabs 28 could be fins or any other suitable flame holder.

Burner 20 includes a porous wire gauze 26 for stabilizing the simmer flame 30 at low input rates and flame stabilization tabs 28 for stabilization at higher rates, such as, during the operating of cooking flame 32. In particular, during the simmer operation or first stage of operation, the highly aerated fuel/air mix entering burner 20 passes through wire gauze 26 and combusts at the outer surface which is shown as simmer flame 30. This results in both radiant and convective heating of the load. Such gauze material should, typically, support a combustion density of 0.2 to 0.8 $W/mm^2$, which corresponds approximately to burner input rates of 1000 to 4000 BTU/hr for a 3 inch burner. However, the expected thermal efficiency at this point is low, and excellent simmer performance is expected. The fine pore size of gauze 26 is smaller than the critical quenching diameter and prevents the flame 30 from flashing back into burner 20.

At higher input rates or during the second stage of operation, the simmer flame 30 will lift or blow off the surface of gauze 26, and will be stabilized in the recirculation zones behind flame holding tabs 28 in the form of cooking flame 32. The surface velocity at blow off (4000 BTU/hr) is expected to be approximately 1 ft/sec for a 3 inch burner, which is well within the expected stability limits of tabs 28. The relatively low velocity will also limit noise.

With respect to the cleanability of burner 20, it can be seen in FIG. 2 that if a conventional cookware such as that shown in FIG. 1 is placed on cooktop 34 and the contents in the cookware are allowed to boil over, that the contents that boiled over should not come into contact with gauze 26 and adversely affect the operating characteristics of burner 20. This is because gauze 26 is located in a recessed position with respect to the edge of cooktop 34 and tabs 28 such that the boiled over contents should not be able to splash back onto gauze 26. Instead, the boiled over contents should merely drip down below tabs 28 where these contents would be easily cleaned up.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. A gas burner wherein said burner is comprised of:
a fuel/air introduction means;
a flame stabilization means for stabilizing a flame at a low input rate located adjacent to said fuel/air introduction means; and
a flame holding means for stabilizing a flame at a high input rate located adjacent to said flame stabilization means.

2. The gas burner, as in claim 1, wherein said flame stabilization means is further comprised of:
a porous gauze.

3. The gas burner, as in claim 1, wherein said flame stabilization means is further comprised of:
a porous wire gauze.

4. The gas burner, as in claim 1, wherein said flame stabilization means is further comprised of:
a porous metal gauze.

5. The gas burner, as in claim 1, wherein said flame stabilization means is further comprised of:
a porous ceramic gauze.

6. The gas burner, as in claim 1, wherein said flame holding means is further comprised of:
tabs.

7. The gas burner, as in claim 1, wherein said flame holding means is further comprised of:
fins.

8. The gas burner of claim 1 wherein said flame stabilization means is located in a recessed position with respect to said flame holding means.

9. A gas burner comprising:
a fuel/air inlet;
a mixing area fluidly connected to said fuel/air inlet;
a porous gauze located adjacent to said mixing area wherein said gauze stabilizes a flame at a low input rate; and
a plurality of tabs located adjacent to said gauze wherein said tabs stabilize a flame at a high input rate.

10. The gas burner of claim 9, wherein said gauze is located in a recessed position with respect to said plurality of tabs.

11. The gas burner of claim 9, wherein said gauze is made of ceramic material.

12. The gas burner of claim 9, wherein said gauze is made of metal.

13. The gas burner of claim 9, wherein said gauze supports a combustion density of 0.2 to 0.8 $W/mm^2$.

* * * * *